US006065974A

United States Patent [19]

Schempp et al.

[11] Patent Number: 6,065,974

[45] Date of Patent: May 23, 2000

[54] ROTARY CONNECTOR ASSEMBLY

[75] Inventors: Otto Schempp, Bad Rappenau; Michael Fasold, Leutenbach, both of Germany

[73] Assignee: Molex Incorporated, Lisle, Ill.

[21] Appl. No.: 09/188,044

[22] Filed: Nov. 6, 1998

[30] Foreign Application Priority Data

Nov. 11, 1997 [DE] Germany ..... 297 19 983 U

[51] Int. Cl.[7] ..... H01R 39/00

[52] U.S. Cl. ..... 439/26

[58] Field of Search ..... 439/23–26, 20, 439/21, 28

[56] References Cited

U.S. PATENT DOCUMENTS

| | | | |
|---|---|---|---|
| Re. 32,805 | 12/1988 | Engelmore et al. | 439/26 |
| 4,472,010 | 9/1984 | Parnello | 339/8 |
| 4,583,797 | 4/1986 | Engelmore et al. | 339/6 |
| 4,590,337 | 5/1986 | Engelmore | 179/186 |
| 4,673,228 | 6/1987 | Ditzig | 439/21 |
| 4,699,591 | 10/1987 | Gallo et al. | 439/21 |
| 4,699,592 | 10/1987 | Gallo et al. | 439/27 |
| 4,764,121 | 8/1988 | Ditzig | 439/21 |
| 4,773,866 | 9/1988 | Basques | 439/21 |
| 4,850,880 | 7/1989 | Zayat, Jr. et al. | 439/11 |
| 4,854,881 | 8/1989 | Ditzig | 439/26 |
| 4,932,882 | 6/1990 | Kang | 439/22 |
| 5,049,083 | 9/1991 | Lin | 439/26 |
| 5,054,189 | 10/1991 | Bowman et al. | 439/25 |
| 5,082,448 | 1/1992 | Kang | 439/22 |
| 5,106,306 | 4/1992 | Ditzig | 439/26 |
| 5,234,347 | 8/1993 | Kang | 439/26 |
| 5,435,731 | 7/1995 | Kang | 439/26 |
| 5,775,922 | 7/1998 | Kilstrom | 439/26 |

*Primary Examiner*—Gary F. Paumen
*Attorney, Agent, or Firm*—A.. A. Tirva

[57] ABSTRACT

A rotary connector assembly has a rotor with a receptacle for an associated electrical connector, stator contacts, first contacts arranged in the receptacle that make an electrical connection to contacts of the associated electrical connector, a housing in which the rotor is rotatably arranged, and rotor contacts arranged on the rotor and electrically connected to the first contacts that make an electrical connection to the stator contacts. The rotor contacts include wound wire on which the stator contacts abut laterary. The rotor contacts are arranged mutually spaced apart radially on a section of the outer circumference of the rotor. Leads to the rotor contacts have a portion arranged running in an axial direction in radial recesses of the rotor.

20 Claims, 9 Drawing Sheets

ROTARY CONNECTOR ASSEMBLY

FIELD OF THE INVENTION

The invention relates in general to a rotary connector, and in particular to a rotary connector assembly having a rotor with a receptacle for an associated electrical connector.

Rotary connectors are used, for example, in electrical equipment in order to prevent a turning or twisting of their leads. In particular, in the case of helical cords which find application, for example, in conventional telephones for connecting the handset to the telephone equipment, it is particularly inconvenient when such twisting leads to knotting of the cord, thereby resulting in both an unsightly appearance and also, besides the mechanical loading of the cord, a shortening of the available length. Discussion of Relevant Art Attempts have already been made to master this trouble by means of adapters which have rotary connectors. See in this connection, for example, U.S. Pat. Nos. 4,472,010, 4,673,228, and 5,049,083. However, there is a disadvantage here that such adapters which project from the telephone handset are very prone to mechanical damage, and as a rule detract from the design of the telephone handset.

Attempts have further been made to integrate a rotary connector assembly into the housing of a telephone handset; see, for example, U.S. Pat. No. 4,854,881.

In general, and in the contacts of rotary electrical connectors, it is important that in order to always ensure good electrical contact, it is indispensable that the contact pressure does not fall below a minimum value. This however may lead to friction between the rotor contacts and stator contacts, which results as a resistance to rotation. Since helical cords, for example, have only very small restoring forces against twisting, the undesired twisting and knotting of such cables frequently occurs in spite of the use of rotary connectors.

Furthermore, in most cases wound sheet metal strips were used as rotor contacts, which produce irregularities at the place where they overlap radially or at the place where they meet radially, and both conditions may lead to contact faults and also to a local, strongly increased resistance to rotation.

SUMMARY OF THE INVENTION

The invention consequently has as its object to further develop a rotary connector, not only with smaller resistance to rotation, but also a good electrical contact with an inserted connector. This object is attained by means of a rotary connector assembly with the following features: a rotor with a receptacle for an associated electrical connector, stator contacts, first contacts arranged in the receptacle that make an electrical connection to contacts of the associated electrical connector, a housing in which the rotor is rotatably arranged, and rotor contacts arranged on the rotor, electrically connected to the first contacts that make an electrical connection to the stator contacts, the rotor contacts including wound wire on which the stator contacts abut laterally. In one embodiment, the rotor contacts are arranged mutually spaced apart radially on a section of the outer circumference of the rotor, and leads to the rotor contacts have a portion arranged running in an axial direction in radial recesses of the rotor.

If the rotor contacts are made of wound wire on which the stator contacts abut laterally, very small radii are thereby made possible in the contact region between the rotor contact and stator contact, since in particular the bending radii of the winding wires can be made very small.

The resistance to rotation is reduced in proportion to the radius, with otherwise identical frictional forces, because of the small diameter of the rotor contacts. Furthermore, no troublesome abutting edges or overlapping places appear.

Furthermore, because of the lateral abutment of the stator contact on a winding, there is always at least one exactly defined abutment, since a cylindrical contact with defined elastic deformation appears in the contact region. In addition, there are self-cleaning effects because of the screw-like external shape of the winding, since dust can deposit between the individual winding turns and is subsequently "screwed out" upward or downward by the rotary motion.

The wire may be wound on the rotor as a monofilar winding with little lateral spacing or no spacing, this can be done very quickly during production or a simple winding process, and the effective resistance of the winding can be reduced by a lateral abutment of the wires against each other.

A further reduction of the resistance of the rotor contacts is possible by the use of a bifilar winding of wire wound on the rotor. Furthermore, it is within the scope of the invention to provide more than one layer of windings, so that electric contact is respectively produced by the subsequent layer between the windings of the underlying layer.

The wire may be wound on a portion of its periphery facing the rotor lies in a positively locking manner on the rotor, preferably in associated helical depressions, this makes possible a high mechanical strength and also a low sensitivity to external vibration during operation, and also a lower lateral wear due to lateral slipping of the wound wire relative to the stator.

The rotor may be made of thermoplastic material and if the wound wire is embedded at a portion of its outer circumference in the rotor, for example by winding a preheated wire onto it, the mechanical strength of the winding is further improved. The preheating of the wire can take place at known winding speeds by irradiation with infrared radiation, inductive coupling of electric currents, or the like, for example.

In the preferred embodiment according to the invention, the wound wire comprises unlacquered copper wire, and has a diameter of 0.01–0.8 mm.

By coating the wire with a noble metal, particularly gold or possibly nickel-palladium, the corrosion resistance can be improved, and mechanical abrasion and the contact friction can be further reduced.

A small diameter of the rotor contacts, particularly in multipole rotary connector assemblies, can be further supported in that the rotor contacts which are arranged mutually spaced apart radially on a section of the outer circumference of the rotor, are provided with leads which run in the axial direction in radial recesses of the rotor.

By the formation of radial recesses which preferably run axially beneath the rotor contact winding, leads can be brought to the rotor contacts from the respective end, and require practically no circumferential widening, even for example with four-pole rotary connectors, in comparison with connectors with fewer poles.

Such multipole embodiments can also be applied in an advantageous manner to other electrical equipment than telephone handsets, for example, keyboard cords for computers, and connections of external pointing devices such as mouse, trackball, joystick or touchpad.

In such multipole rotary connectors, a portion of the leads can furthermore be cast into the rotor body in order in this manner to use the remaining space within the rotor contacts in a particularly suitable manner.

A further advantageous improvement of production and costs results when the first contacts, which make the contact to the external connector, are respectively constructed integrally with the part of the lead embedded by injection molding.

A rotary connector according to the invention, for example for the telephone connector also known as a modular plug, can be most advantageously provided with the required elastic restoring forces by bending the contact sections around which project from the cast-in section.

Moreover the elastic contact forces of the stator contacts can advantageously be formed so that these abut the rotor contacts on both sides such that their contact forces are substantially compensated in the radial direction. An elastic centering in the region of the stator contacts is thus obtained, and opposes an undesired tilting of the rotor.

A further reduction of the rotary resistance results when respective inner and end slide bearings are constructed on the rotor and within the housing of the connector assembly. With this arrangement of the rotary bearings, the greatest possible dimension is used for the connector assembly, such that production tolerances with a predetermined play will generally permit only the smallest possible tilting. If a slide bearing is arranged at the end of the rotor remote from the connector, and a ball bearing is arranged in the region of the plug opening of the connector, a further reduction of the mechanical rotation resistance is obtained.

A simplification of manufacture results when the housing of the rotary connector assembly has a lateral plug opening, into which the stator contacts can be inserted laterally.

BRIEF DESCRIPTION OF THE DRAWINGS

The invention is described in more detail hereinbelow by means of preferred embodiments and with reference to the accompanying drawings, in which.

DETAILED DESCRIPTION OF PREFERRED EMBODIMENTS

Figure 1:
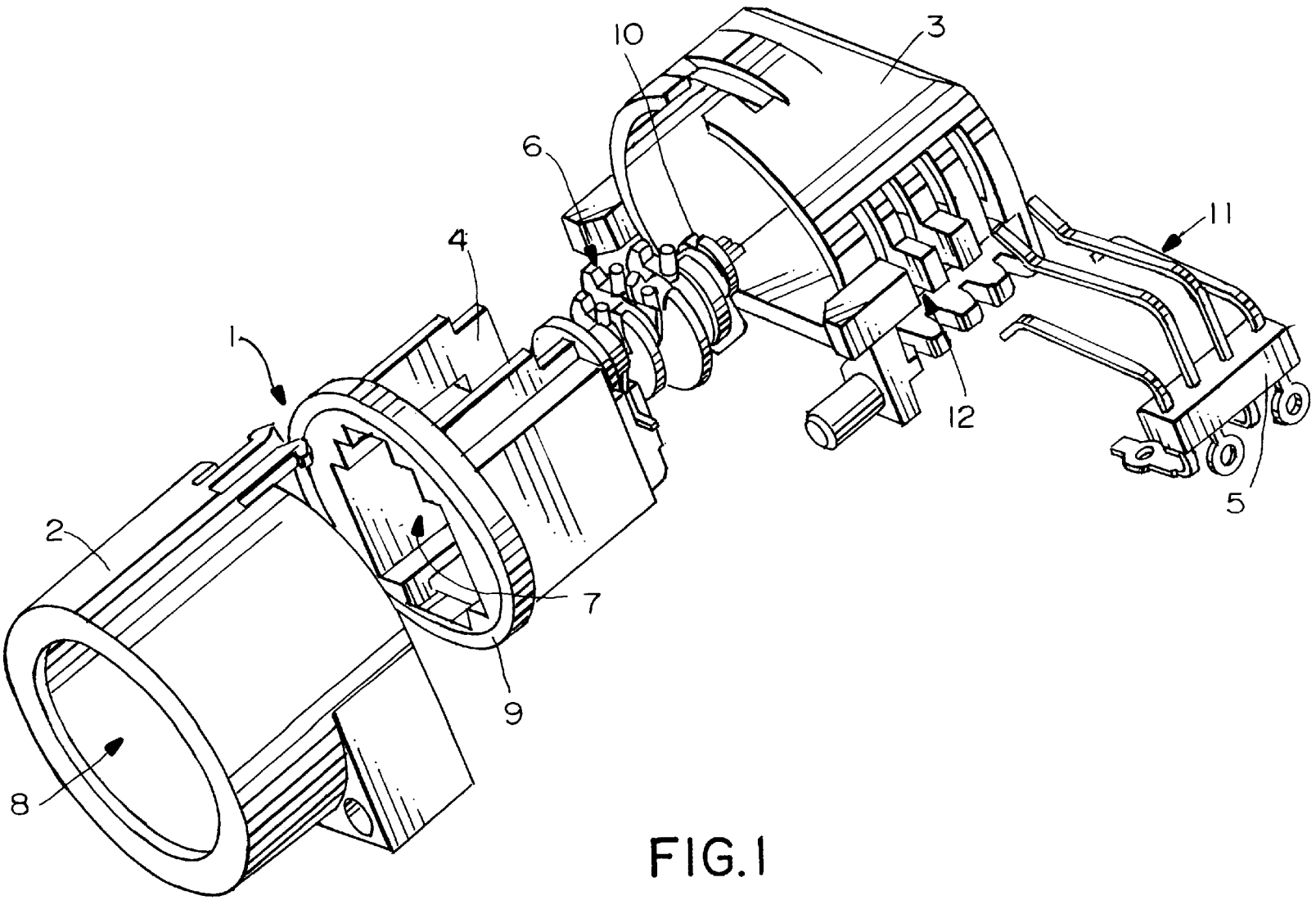
FIG. 1 shows a first embodiment according to the invention of a rotary connector assembly with two slide bearings, in an exploded diagram.

In the following detailed description, reference is first made to the exploded diagram of FIG. 1. The rotary connector assembly denoted overall by 1 includes a housing consisting of two half-shell portions 2, 3, in which the rotor 4 is rotatably mounted.

A stator contact assembly 5 can be pushed in from the side into the housing portion 3 so that a connection to the rotor contacts 6 is established.

A bushing or receptacle 7 of the rotor 4 in the first embodiment according to the invention is suitable for receiving a plug usually used for telephone cords, also known as a modular plug (RJ-45), the receptacle 7 being accessible from outside the rotary connector assembly 1 through an opening 8 of the housing portion 2. In this embodiment according to the invention, slide bearings 9, 10 are arranged at the ends of the rotor 4, and are accommodated in associated bearing shells of the housing portions 2, 3, which are concealed in perspective in FIG. 1, after the housing portions 2, 3 are fitted together. The stator contact assembly 5, with its sliding contacts 11, can then be pushed laterally into the associated opening 12 of the housing portion 3 so that a positively locking, mechanically firm seating results. The sliding contacts 11 then grip the rotor contacts 6 on both sides.

Figure 2:
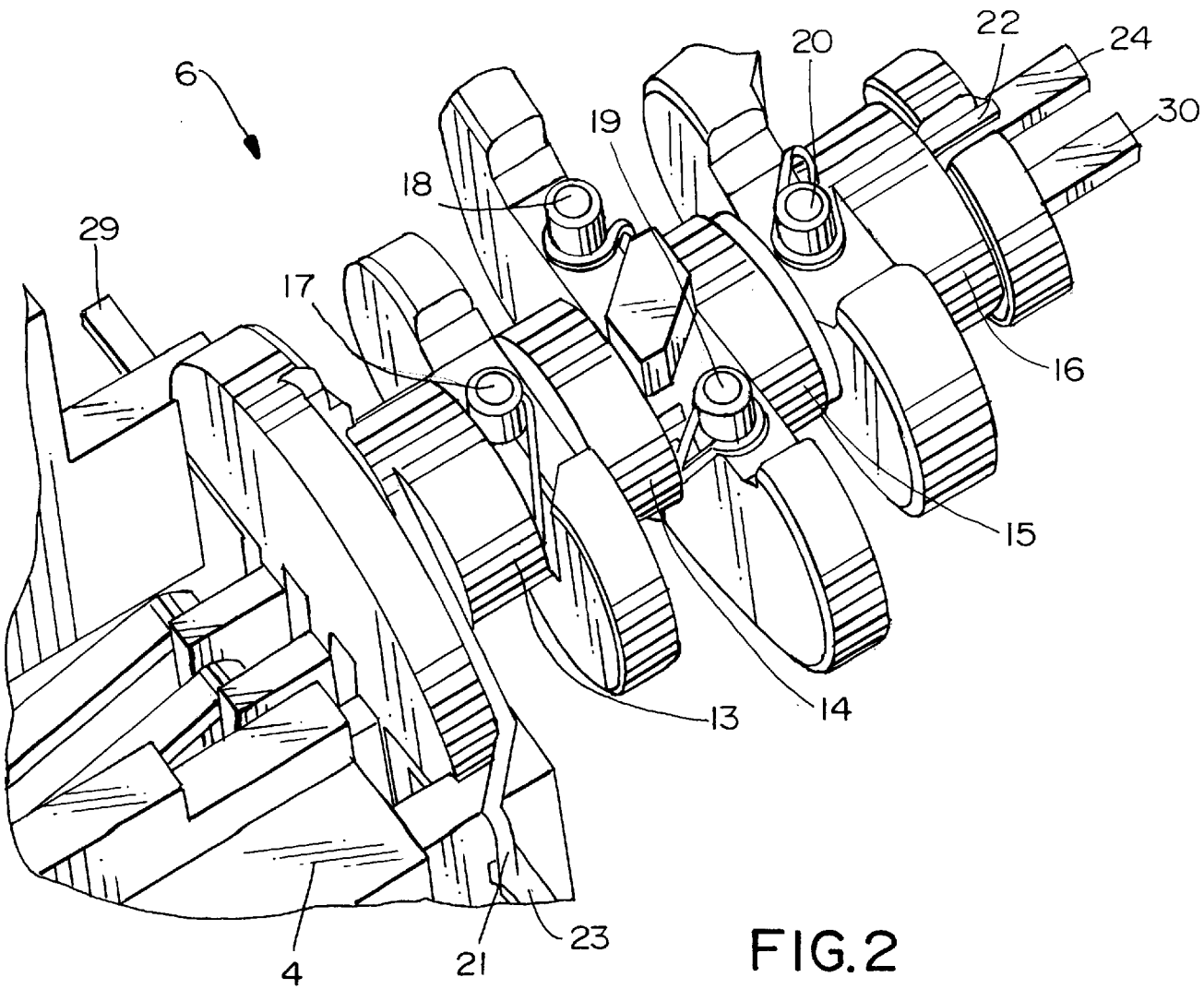
FIG. 2 shows an enlarged perspective view of a portion of the rotor, with rotor contacts arranged thereon.

Referring next to FIG. 2, which shows in perspective an enlarged section of the rotor 4 in the region of its contacts 6. Without limiting the generality of the invention, the following explanation takes a four-pole rotary connector assembly as an example; the embodiments according to the invention also permit a one, two, or up to eight pole arrangement.

For each pole, the rotary connector assembly has a respective associated winding 13, 14, 15 and 16, which are axially spaced apart and held at the end on a respective fastening pin 17, 18, 19 and 20. In the case of monofilar windings 13, 14, 15, 16, their ends can be positively locked and held, when pressed by fastening pins 17, 18, 19, 20 into an associated opening, or for example by thermal deformation.

In the case of bifilar windings, the closed loop-shaped end of the winding 13, 14, 15, 16, as shown in Fig, 2, can be laid around the respective fastening pin 17, 18, 19, 20 and can be held under prestress by the winding process.

As will further be apparent from Fig, 2, the respective winding starts 21, 22 of the outside windings 13, 16 are connected for electrical conduction to leads 23, 24 which extend into the body of the rotor 4.

Figure 3:
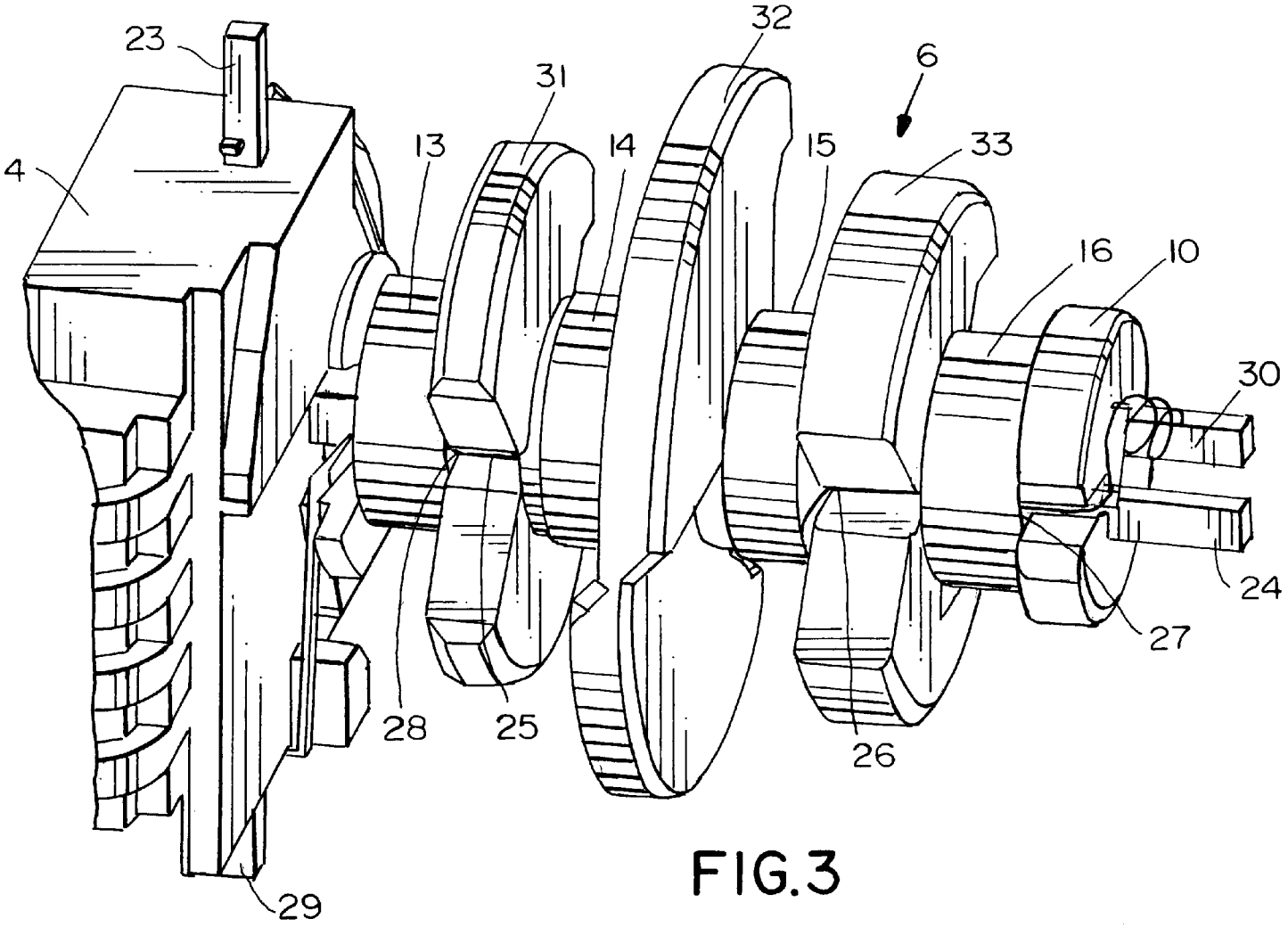
FIG. 3 shows a further perspective view of the rotor with rotor contacts arranged thereon, in which the rotor is turned through about 180° relative to the view in FIG. 2.
Figure 4:
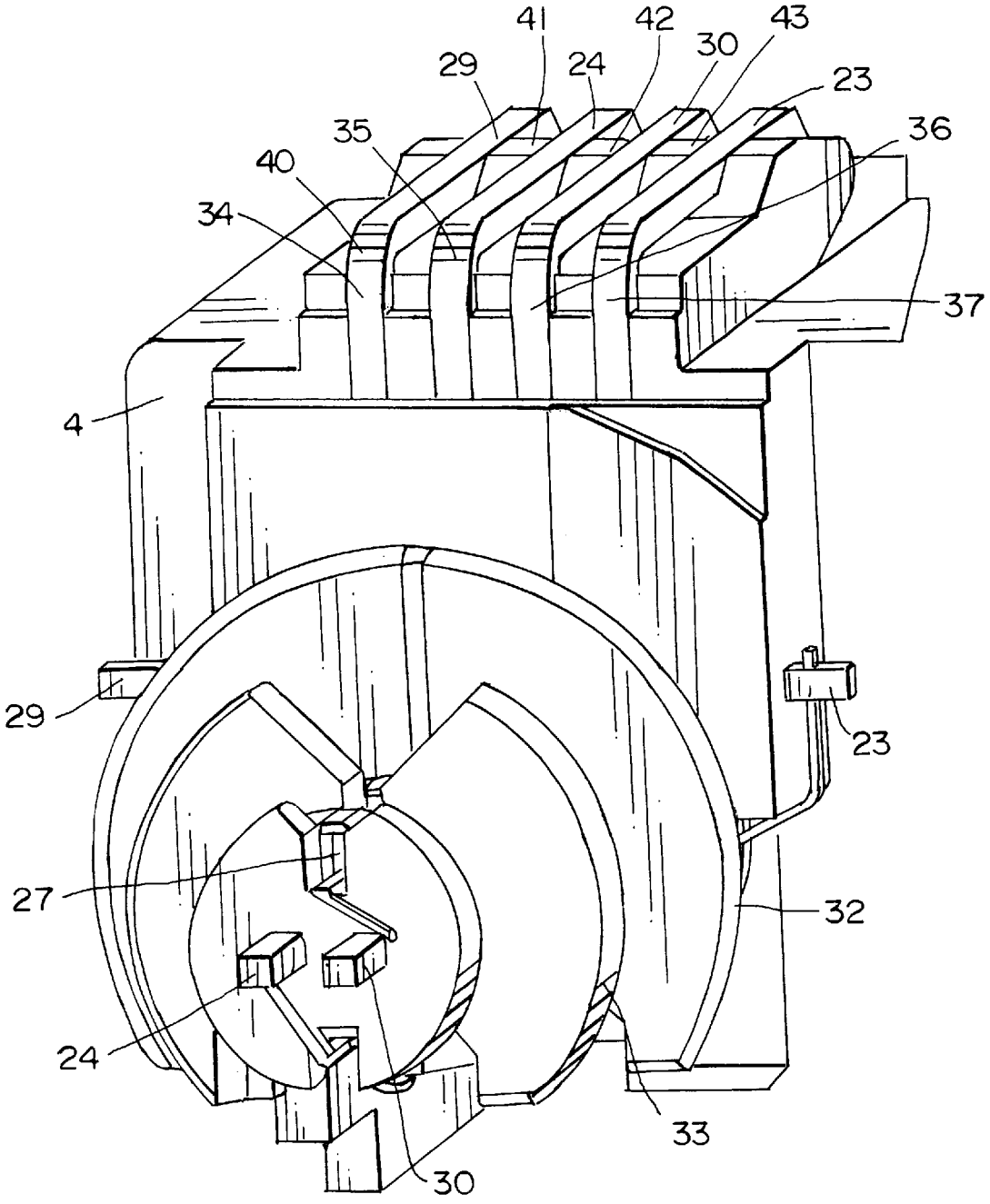
FIG. 4 is a top view of the rotor from the front.

Reference is now made to FIG. 3, which shows in perspective the rotor contacts 6 in an arrangement turned through about 180° relative to FIG. 2. It will be apparent from FIG. 3 that the winding starts 25, 26 of the inside windings 14, 15, and which likewise serve as leads to the windings, run in mutually opposite directions through and under the outside windings 13, 16 in axially directed, radially offset inward, recesses 27, 28. In this manner, it is possible to pass the winding starts 25, 26 to their respective leads 29, 30, electrically insulated from the outside windings 13, 16, without an increase of the diameter of the windings 13, 14, 15, 16 being necessary in the radial direction.

Such an arrangement of the electrical connections is of particularly great advantage, for example, in four-pole and multi-pole rotary connector assemblies, since in this case a portion of the leads 24, 30 to the windings located inside can be passed parallel to the rotation axis of the rotor 4.

The individual windings 13, 14, 15, 16 are separated by walls 31, 32 and 33 which lie between them and which likewise form a lateral guide for the sliding contacts 11 of the stator contact assembly 5. The outer edge of the righthand outer winding 16 is constructed as the inner bearing shell of the slide bearing 10 which in the mounted state comes to abut both at its outer circumference and at the end on an associated bearing shell of the housing portion 3.

Reference is now made to FIGS. 4–8, in order to explain in more detail the further location of the leads 23, 24, 29 and 30. The leads 24, 30 are embedded in the body of the rotor 4 by injection molding, and extend about parallel to the rotation as far as behind the winding 13, where they undergo a bend through about 90°, still cast into the rotor 4.

Figure 6:
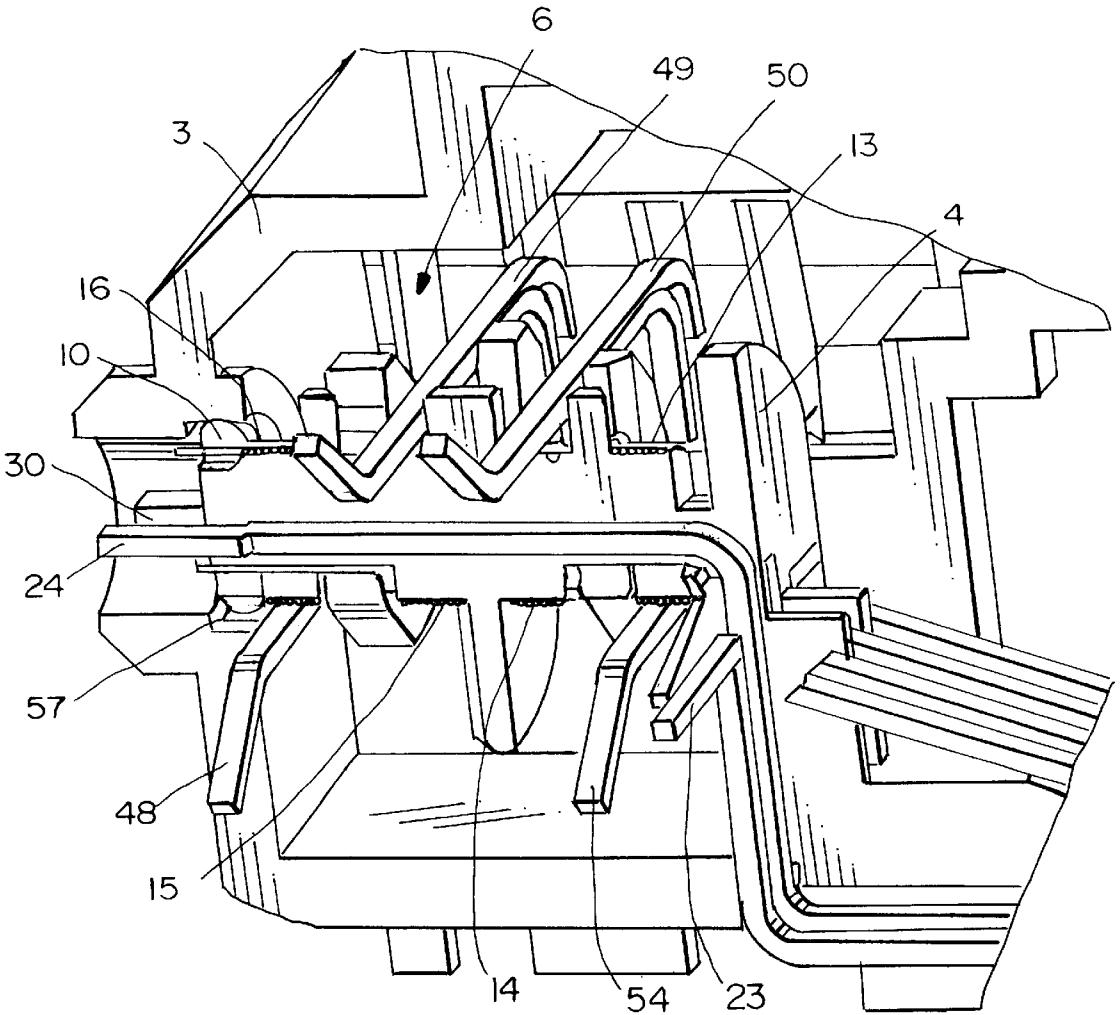
FIG. 6 is a cross sectional view which runs through the rotor in the region of the rotor contacts, and which is enlarged and slightly tilted relative to the view shown in FIG. 5.
Figure 7:
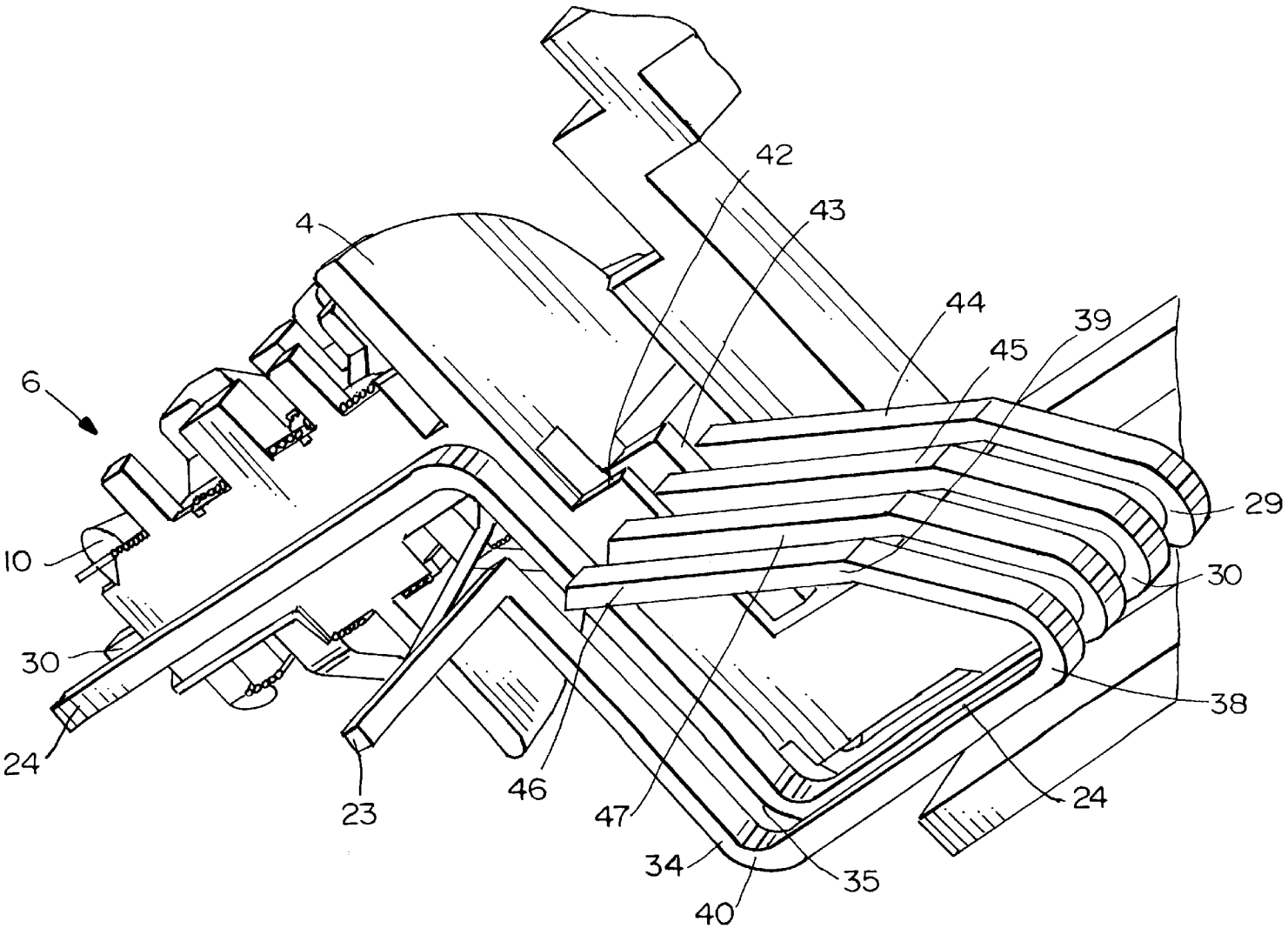
FIG. 7 is a perspective cross sectional diagram of the rotor with a view of the bent-around elastic contacts for the external connector.

As is particularly apparent from FIGS. 6 and 7, the lead 23 also undergoes a 90° bend after a short distance within the body of the rotor 4.

All four leads 23, 24, 29 and 30 emerge from the rotor 4 perpendicularly of the rotor axis at associated exit locations 34, 35, 36, 37, a short distance behind the rotor contacts 6, and have a predetermined free length.

During the production of the rotor 4, the leads 23, 24, 29, 20, as can best be seen in FIG. 7, undergo three further bends, which will be explained, by way of example, for the lead 23. Firstly, a substantially V-shaped end is formed by the bends 38, 39, and is then pivoted by the bend 40 into the body of the rotor 4 in respectively associated separate openings through the wall sections 41, 42, 43. In this manner, the respective V-shaped end sections form resiliently prestressed bushing contacts 44, 45, 46, 47 for the production of an electrical connection to an associated Western plug.

The bushing contacts 44, 45, 46, 47, and also the leads 23, 24, 29, 30 which are made integral with them, are of stamped sheet metal or wire, and may optionally be coated with noble metal.

Figure 9:
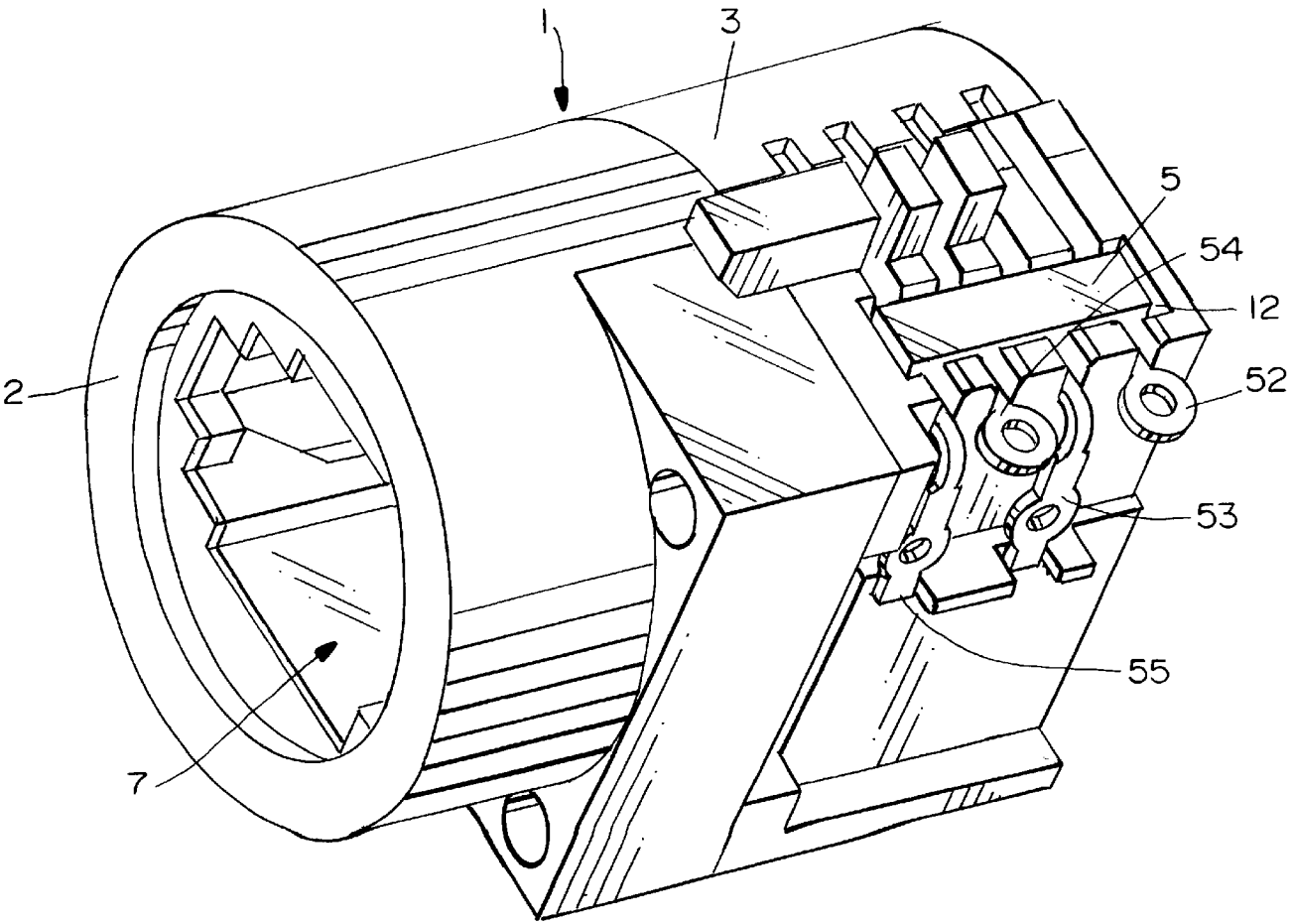
FIG. 9 is a perspective elevation view, obliquely from below, of a mounted rotary connector assembly.

Thus when an external connector is plugged in, contact is first made to the bushing contacts 44, 45, 46, 47 in the rotary connector assembly 1, along the leads 23, 24, 29, 30 to the winding starts 21, 22, 25, 26, and passed through these to the Windings 13, 14, 15, 16, and from there, to the stator contacts 48, 49, 50, 51, which are constructed as sliding contacts, and produce an electrical connection to the outer housing connections, which are apparent from FIG. 9, for example.

The outer housing connections 52, 53, 54, 55 are not limited by the invention in their generality and can, for example, be soldered connections, pin connections, wire wrap connections, solder surfaces for surface mounting, or contact press surfaces for foil conductors, and also connections which pass through insulation.

Figure 8:
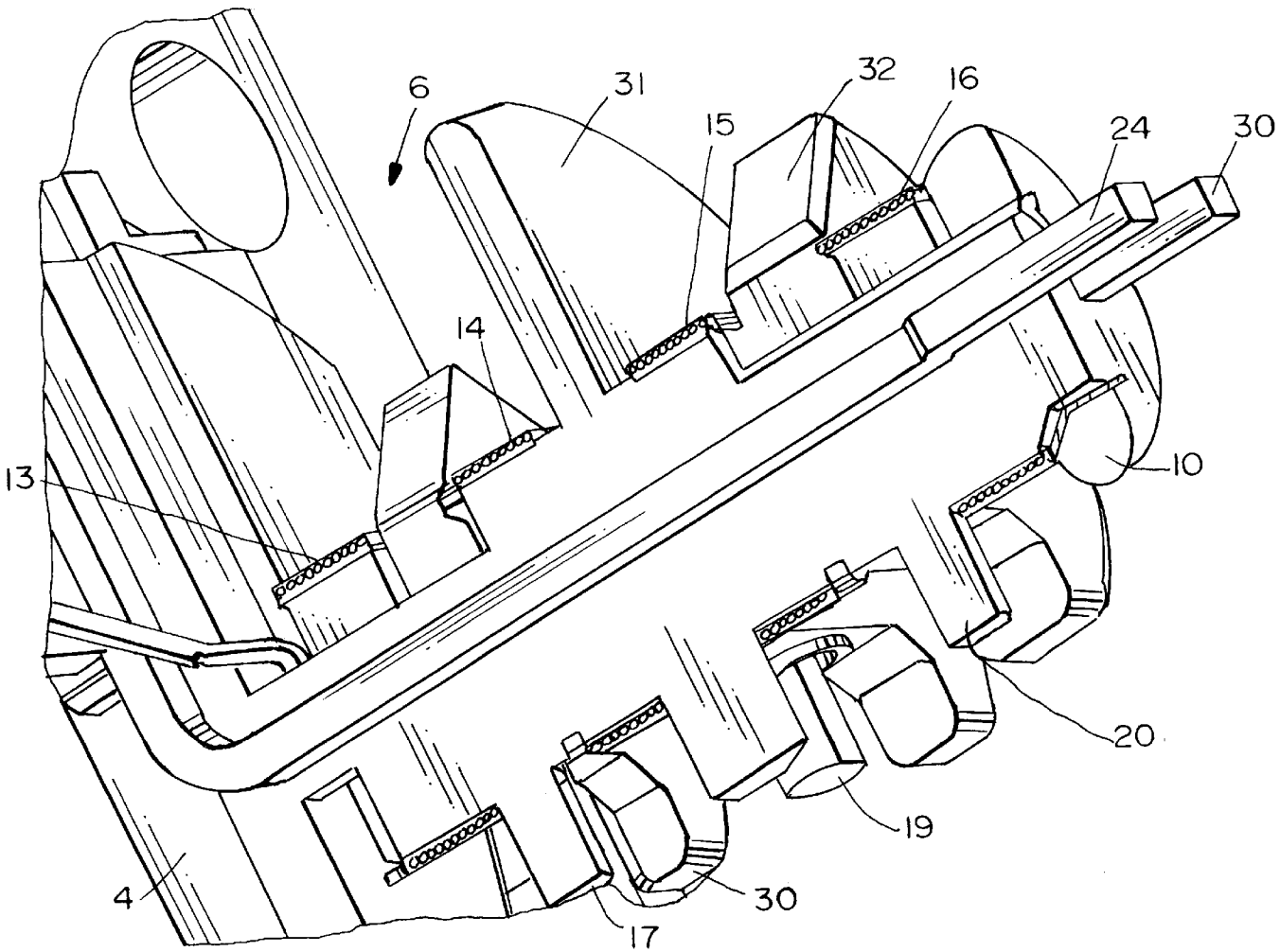
FIG. 8 is a further cross sectional view through the rotor in the region of the rotor contacts, showing the respective windings in detail.

For a further explanation of the connection between the rotating and stationary part of the rotary connector assembly, reference is made hereinbelow to FIGS. 6 and 8.

The inner sides of the stator contacts 48, 49, 50, 51 which face the rotor 4 and in particular the windings 13, 14, 15, 16 are substantially planar or slightly convex. This leads substantially to a one-point or two-point abutment on the winding 13, 14, 15, 16 associated with the respective stator contact 48, 49, 50, 51. This point contact may be formed by selection of the contact pressure and the elastic properties of the materials used such that an exactly defined abutment surface always results and is free from disturbances both from external shaking and also during the rotation of the rotor 4.

In order to securely exclude movements of the windings 13, 14, 15, 16 in the axial direction of the rotor 4, the respective windings are wound with their turns laterally against each other, and in this manner also make available electrical contact between individual turns.

Furthermore, the rotor 4 may have helical recesses beneath the respective windings 13, 14, 15, 16, to receive the winding turns in a positively locking manner.

Alternatively, with a thermoplastic rotor 4, the wire may be wound thereon while preheated, so that the first layer of winding is embedded in part of the outer circumference of the rotor 4.

According to the invention, one or more layers of winding may be placed on, wherein two layers provide good electrical contact through the adjacent upper layer to the lower layer.

The winding wire is preferably an unlacquered copper wire with a diameter of 0.01–0.8 mm, suited for the intended use. The wound wire may furthermore be provided with a coating, the material of which contains a noble metal, particularly gold or nickel palladium.

Figure 5:
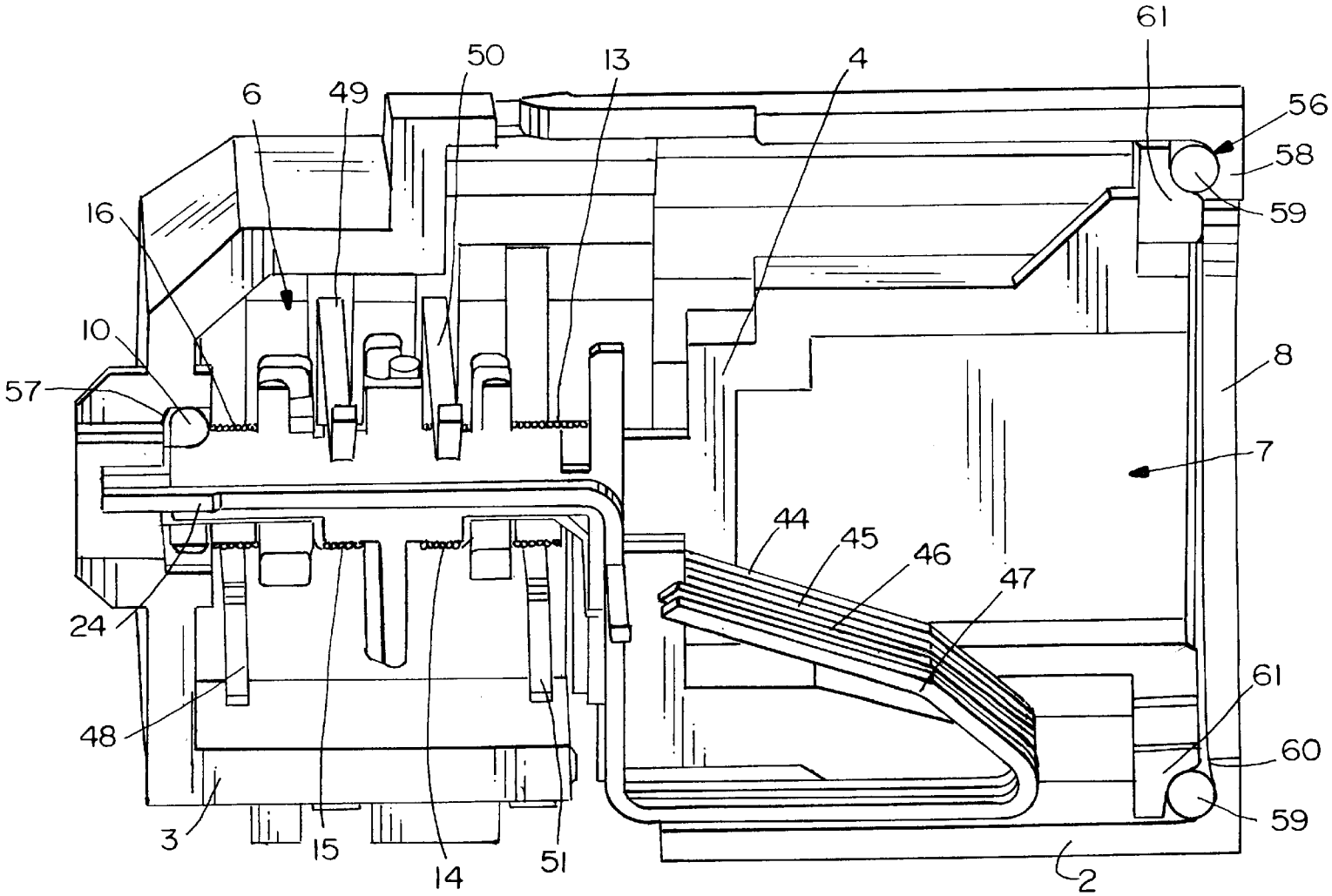
FIG. 5 is a cross sectional diagram, about horizontally in the middle, through a mounted rotary connector assembly with a slide bearing and a ball bearing.

Reference is now made to the cross sectional diagram of FIG. 5 for an explanation of an alternative embodiment of the rotary connector assembly 1, in which both a slide bearing 10 and a ball bearing 56 are made use of. In this embodiment, a slide bearing 10 which acts both axially and radially is arranged on the end of the rotor 4 in the neighborhood of the rotor contact 6, the rotor shell being held within a slide bearing shell 57 of the housing portion 3. The combination of the bearing shell 57 and slide bearing portion 10 has only small radii, so that the frictional forces thereby developed provide only a small resistance to a torque.

Since however, the diameter of the ball bearing 56 at the other end of the rotary connector assembly has to be larger than that of the opening 8 and also the open width of the receptacle 7, greater radii at these places are unavoidable. Consequently, the ball bearing 56 has a very advantageous action on the frictional values opposing a rotation.

Also, the ball bearing 56 is constructed as an axial and radial bearing. For this purpose, the inner bearing shell 61 and the outer bearing shell 58 engage around the spherical rolling element 59 over an angular region which is advantageously not less than 90°, i.e., extends from a direction running parallel to the rotation axis of the rotor 4 as far as a direction which is perpendicular to the rotation axis of the rotary body.

The outer circumference of the inner bearing shell 61 has a defined play with respect to the inner wall of the housing portion 2, it is possible to securely exclude bearing damage, even under the action of high forces. If the action of a large force through the rolling element 59 results in a deformation of the bearing shells 61, 56, the inner bearing shell 61 can come directly into contact with the housing portion 2 and prevent a further deformation of the bearing shells 61 and 58 due to the rolling element 59. If in this case a deformation in the purely elastic region is not exceeded, no damage can be detected after the end of the action of the external force.

The outer bearing shell 58 has a projection 60 which extends beyond the rolling element 59, and to a small extent extends into the interior of the housing, an axial trough is formed all around, in which rolling elements 59, which are put in during mounting can remain lying stably, simplifying the manufacture.

It falls within the scope of the invention to use the mounted rotary connector assembly 1 shown in FIG. 9 in varied electrical and electronic devices, which are preferably operated with low voltage. According to the invention, these are telephone handsets, telephone equipment, computers, in particular their connections for keyboards and pointing devices, as for example connections for mouse, joystick, trackball, or touchpad. However, it is likewise possible to arrange the rotary connector assembly in the respective pointing device itself.

It is furthermore within the scope of the invention to construct the housing portion integrally as a portion of an electrical equipment.

We claim:

1. A rotary connector assembly comprising:

a rotor with a receptacle for an associated electrical connector, stator and contacts, first contacts arranged in said receptacle that make an electrical connection to contacts of the associated electrical connector, a housing in which said rotor is rotatably arranged, and rotor contacts arranged on said rotor, electrically connected to said first contacts that make an electrical connection to said stator contacts, said stator contacts being associated with said housing, said rotor contacts including wound wire on which said stator contacts abut laterally.

2. The rotary connector assembly according to claim 1, in which said wound wire is wound as a monofilar winding on said rotor with a small lateral spacing.

3. The rotary connector assembly according to claim 1, in which said wound wire is wound as a bifilar winding on said rotor with a small lateral spacing.

4. The rotary connector assembly according to claim 1, in which said wound wire at a portion of its circumference facing said rotor abuts on said rotor in a positively locking manner.

5. The rotary connector assembly according to claim 4, in which said rotor comprises a thermoplastic material, and said wound wire is embedded at a portion of its outer circumference in said rotor.

6. The rotary connector assembly according to claim 1, in which said wound wire comprises unlacquered copper wire and has a diameter of about 0.01–0.8 mm.

7. The rotary connector assembly according to claim 1, in which said wound wire is provided with a coating, the material of which is selected from the group consisting of gold, nickel palladium, and other noble metals.

8. A rotary connector assembly comprising:

a rotor with a receptacle for an associated electrical connector, first contacts arranged in said receptacle that make an electrical connection to contacts of the associated electrical connector, a housing in which said rotor is rotatably arranged, stator contacts associated with said housing, rotor contacts including wound wire arranged on said rotor, electrically connected to said first contacts, that make an electrical contact to said stator contacts, said rotor contacts being arranged mutually spaced apart longitudinally on a section of the outer circumference of said rotor, and leads to said rotor contacts having portions arranged running in an axial direction in radial recesses of said rotor.

9. The rotary connector assembly according to claim 8, in which, in order to reduce the diameter of said rotor contacts, a first portion of said leads is arranged running axially in an opposite direction relative to a further portion of said leads.

10. The rotary connector assembly according to claim 8, in which at least a portion of said leads to said rotor contacts is embedded in said rotor by injection molding.

11. The rotary connector assembly according to claim 10, in which about half of said leads to said rotor contacts extend parallel to, and in the neighborhood of, the axis of rotation of said rotor.

12. The rotary connector assembly according to claim 8, in which said first contacts are respectively constructed integrally with said portion of said leads to said rotor contacts embedded in said rotor by injection molding.

13. The rotary connector assembly according to claim 10, in which said first contacts emerging from said injection molded portion are bent around such that elastic restoring forces are provided for abutment on contacts of the associated connector.

14. The rotary connector assembly according to claim 8, in which said stator contacts comprise stationary contacts that abut on both sides of said rotor contacts such that contact forces in the radial direction are substantially compensated.

15. The rotary connector assembly according to claim 8, further comprising slide bearings arranged respectively at the end of said rotor and respectively inside on said housing.

16. The rotary connector assembly according to claim 8, further comprising a slide bearing arranged at the end of said rotor remote from the associated electrical connector, and a ball bearing arranged at the end of said rotor nearer the associated electrical connector that are respectively held in associated bearing shells of said housing.

17. The rotary connector assembly according to claim 8, in which said housing has a lateral plug opening, and said stator contacts comprise stationary housing contacts laterally insertable into said housing when said rotor is in said housing.

18. A housing of an electrical device, including a rotary connector according to claim 1.

19. The housing according to claim 18, in combination with an electrical device selected from the group consisting of a telephone, a telephone handset, a computer, a keyboard and an indicating device for a computer.

20. The rotary connector assembly according to claim 1, further comprising a slide bearing arranged at the end of said rotor remote from the associated electrical connector, and a ball bearing arranged at the end of said rotor nearer the associated electrical connector that are respectively held in associated bearing shells of said housing.

* * * * *